US006013908A

United States Patent [19]

Kume et al.

[11] Patent Number: 6,013,908

[45] Date of Patent: Jan. 11, 2000

[54] COOKING APPARATUS HAVING AUTOMATICALLY STARTING KITCHEN TIMER FUNCTION

[75] Inventors: Kenji Kume, Otsu; Miho Fujii, Kurita-gun; Hideki Yamauchi, Otsu; Masanao Ohashi, Kasai, all of Japan

[73] Assignee: Sanyo Electric Co., Ltd., Moriguchi, Japan

[21] Appl. No.: 09/116,471

[22] Filed: Jul. 16, 1998

[30] Foreign Application Priority Data

Jul. 18, 1997 [JP] Japan ..... 9-194172

[51] Int. Cl.[7] ..... H05B 6/68

[52] U.S. Cl. ..... 219/719; 99/325

[58] Field of Search ..... 219/719, 80, 720, 219/401, 685; 235/92; 99/325, 336, 403

[56] References Cited

U.S. PATENT DOCUMENTS

| | | | |
|---|---|---|---|
| 3,979,056 | 9/1976 | Barnes | 235/92 |
| 4,369,347 | 1/1983 | Shin | 219/719 |
| 4,504,716 | 3/1985 | Sakamoto | 219/759 |
| 4,593,170 | 6/1986 | Maeda et al. | 219/685 |

FOREIGN PATENT DOCUMENTS 7-260162 10/1995 Japan .

*Primary Examiner*—Teresa Walberg
*Assistant Examiner*—Jeffrey Pwu
*Attorney, Agent, or Firm*—Armstrong, Westerman, Hattori, McLeland & Naughton

[57] ABSTRACT

A microwave oven includes a heating chamber containing a magnetron for heating and cooking food S, a body with a door provided in front of the heating chamber, and a control circuitry provided on the body for controlling driving of the magnetron. The control circuitry includes a switch key for switching either to a cooking time input mode for setting and inputting time period for driving magnetron or to an optional timer input mode for setting and inputting time period for an optional timer, input ten keys for inputting the time period of the set input mode, a timer body for separately counting time periods of respective input modes input by the ten keys, a display portion for displaying time count of either one of the input modes switched by the switch key, and a start key for starting time count for the input time period on display portion. When the operation is switched to the optional timer input mode by switch key 22 and an input of the time period for the optional timer is given through ten keys, time count of the time period for the optional timer starts after a prescribed time period, without waiting for an input to start time count from the start key.

8 Claims, 7 Drawing Sheets

COOKING APPARATUS HAVING AUTOMATICALLY STARTING KITCHEN TIMER FUNCTION

BACKGROUND OF THE INVENTION

1. Field of the Invention

The present invention relates to a cooking apparatus, and more particularly, to a cooking apparatus having a timer function for setting an arbitrary time period for a timer.

2. Description of the Related Art

A cooking apparatus of interest to the present invention is disclosed. for example, in Japanese Patent Laying-Open No. 7-260162. This laid-open application discloses, in a cooking apparatus such as a microwave oven, an equipment having a function of common cooking timer controlling time of driving a heater, and a function of an optional timer allowing setting of an arbitrary time period, independent from the cooking timer. In this equipment, the time for driving the heater in the cooking apparatus is counted parallel to counting of the arbitrary time period, and counted times are displayed one at a time on a display unit, by switching operation.

In the above described equipment, it is possible to set the timer for setting the arbitrary time period, hereinafter referred to as an optional timer, while the cooking timer is in operation. If a user is not accustomed to setting of the timer and takes much time for setting, or if the user has to do something else while interrupting the timer setting operation, the equipment is kept in the middle of timer setting operation, that is, the equipment is left in the standby state, waiting for the input of the arbitrary time period. In this state, remaining time of the cooking timer, that is, the remaining time of driving the heater, is not displayed, either. This is inconvenient for subsequent cooking procedure. Further, when the equipment is kept in this state for a considerable time period and the user wishes to operate the cooking timer or the optional timer, there is no information provided on the display for the desired operation, leaving the user confused.

SUMMARY OF THE INVENTION

Therefore, an object of the present invention is to provide a cooking apparatus having an optional timer function which is easy to use.

Another object of the present invention is to provide a cooking apparatus having an optional timer function allowing operation in accordance with user's intention.

An additional object of the present invention is to provide a cooking apparatus having an independent optional timer function.

A still further object of the present invention is to provide a cooking apparatus which readily allows distinction between elapsed time of driving the heater and elapsed time of the optional timer.

A still further object of the present invention is to provide a cooking apparatus capable of providing relevant information to the user.

The above described objects can be attained by the cooking apparatus for heating and cooking food in accordance with the present invention, including a heater for heating food; a mode setting unit selectively setting a first mode for setting time of heating by the heater, and a second mode for setting an arbitrary time period different from that for heating by the heater; and a time input unit for inputting time period in the set mode, when the first or second mode is set by the mode setting unit; in which if the second mode is set by the mode setting unit, counting of the input time period is started automatically after a first prescribed time period from the input through the time input unit.

When the arbitrary time period other than the time period of heating by the heater is set, that is, when the optional timer is set and the time period is input, counting of the time period is automatically started after the lapse of a prescribed time period, even in the absence of user's designation of starting the optional timer. As a result, a cooking apparatus having a user friendly optional timer function is provided.

Preferably, in the absence of input of the time period through the time input unit within a second prescribed time period after setting of the second mode by the mode setting unit, setting of the second mode is changed to the first mode.

Even when the optional timer is set, if there is not the input of the time period within a prescribed time period, it is determined that the use of the optional timer is not intended, and setting is automatically changed to the normal cooking timer for heating. As a result, a cooking apparatus having an optional timer function allowing operation in accordance with user's intention is provided.

Preferably, the cooking apparatus has a display. When both the first and second modes are set by the mode setting unit and counted, the display provides a first time count in the first mode as well as the second time count in the second mode, on a single time count display unit. The time count display unit selectively displays the first and second time counts in mutually distinguishable manner.

When the cooking timer and the optional timer are both in operation, elapsed time periods of both timers are displayed in mutually distinguishable manner on the single time count display unit. Therefore, a cooking apparatus can be provided in which the elapsed time period of the time of driving the heater (cooking timer) and the elapsed time period of optional timer can be distinguished readily at a low cost.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

The present invention will be described in detail with reference to an embodiment shown in the appended drawings.

Figure 1:
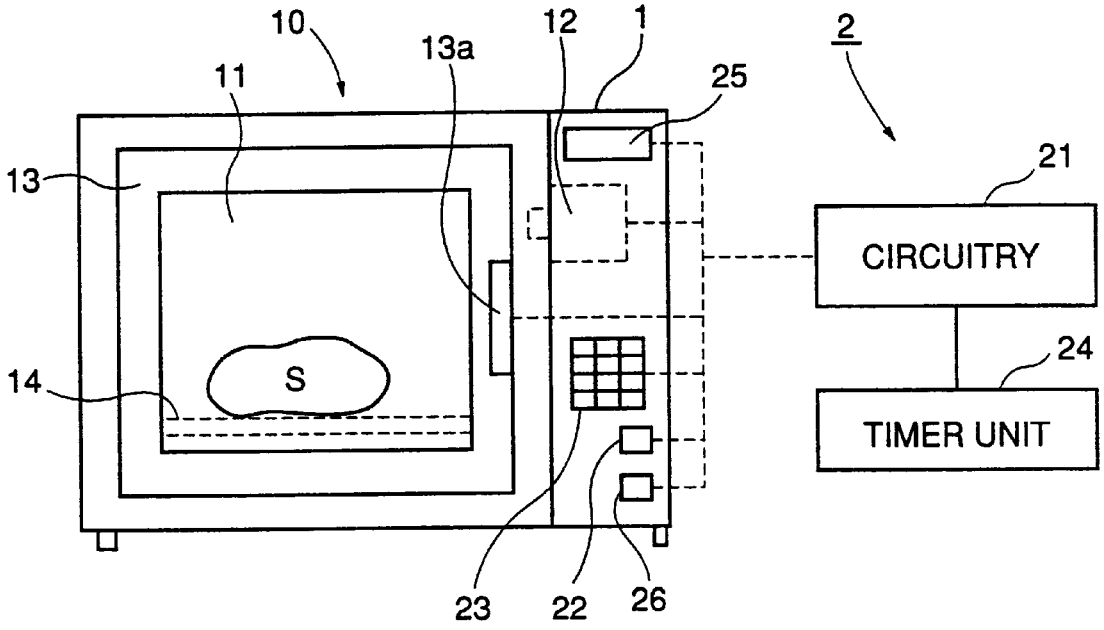
FIG. 1 is a schematic block diagram representing a control circuit of a microwave oven as a cooking apparatus in accordance with one embodiment of the present invention.
Figure 2:
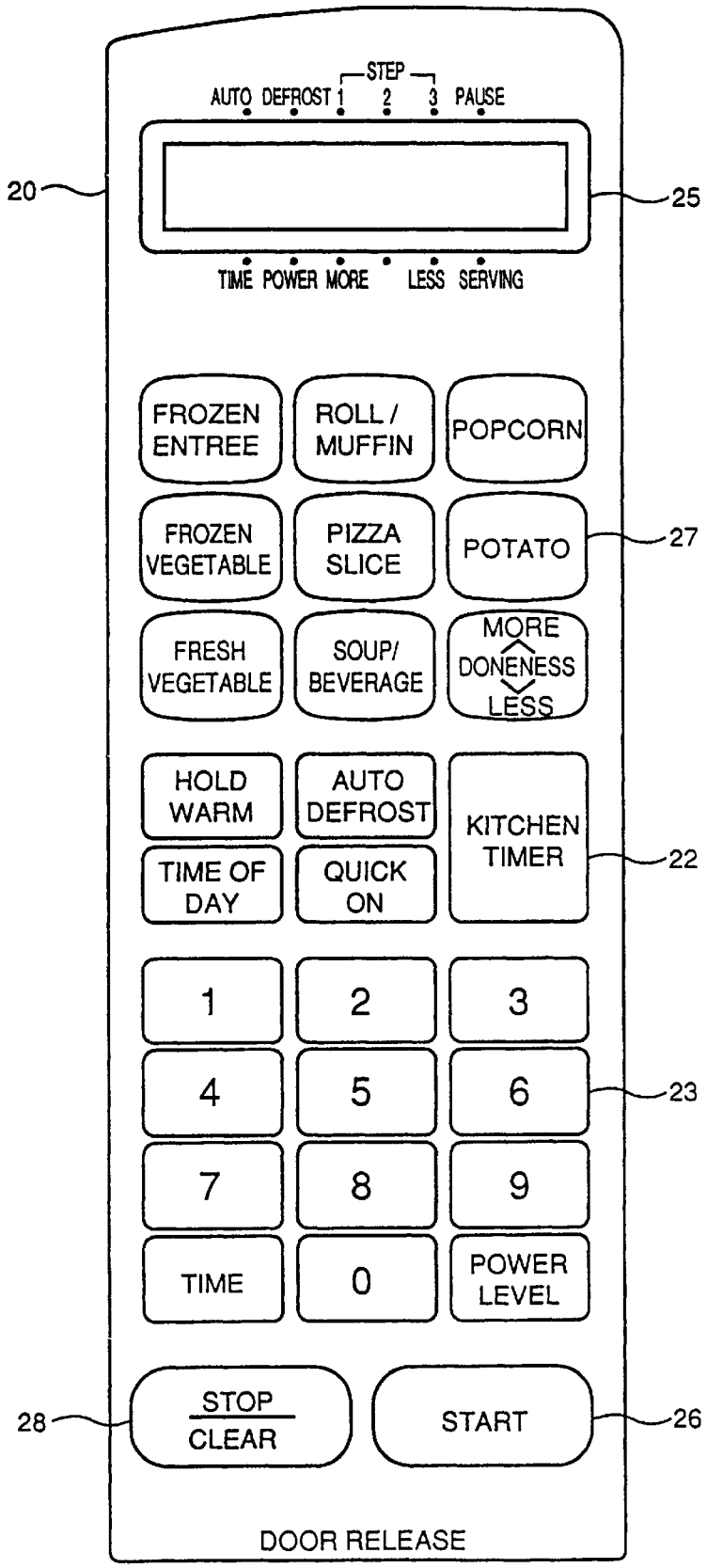
FIG. 2 is a front view of an operation panel constituting the control circuit of the microwave oven shown in FIG. 1.

Referring to FIG. 1, a microwave oven 10 includes a heating chamber11 containing food S to be cooked; a magnetron 12 as a heater heating food S placed in heating chamber 11; a microwave oven body 1 with a door 13 as an inlet for putting in/taking out food S to and from heating chamber 11; and a control circuitry 2 controlling driving of magnetron 12 and so on. A turntable 14 on which food S is placed is provided in heating chamber 11. Door 13 has a door sensor 13*a* for detecting whether the door is open/closed attached thereto on the side facing heating chamber 11.

Control circuitry 2 includes a circuit body 21 including a CPU or the like; a kitchen timer key, or a switch key 22 as a switch for switching operation mode connected to circuit body 21; ten keys 23 as the time input unit; a timer unit 24; a display portion 25 as a display unit; and a start key 26 for designating start of time counting. Further, input/output unit for magnetron 12 and door sensor 13*a* are connected to circuit body 21.

Of these components, switch key 22, ten keys 23, display portion 25 and start key 26 are provided, together with a menu key 27 for selecting a desired one from a variety of menu and a stop/cancel key 28, on an operation panel 20, which panel 20 is placed on a front surface of microwave oven body 1.

Switch key 22 is for setting either one or both of cooking time input mode for setting time of driving magnetron 12 through operation panel 20 and optional timer input mode for setting arbitrary time period also through operation panel 20. Based on the set input mode, the time period is set through ten keys. Timer unit 24 includes two timers for separately counting time periods of respective input modes, input through the operation of switch key 22 and ten keys 23.

Display portion 25 includes a panel body allowing display of multiple digits for displaying time count counted by timer unit 24 of either one of the input modes according to switching by the switch key 22, and LEDs arranged on upper and lower sides of the panel body for indicating the input mode and a cooking mode, for example, set by the menu key 27. Start key 26 is for instructing start of counting time of respective input modes, input through switch key 22 and ten keys 23.

The operation of microwave oven 10 will be described with reference to the flow chart of FIGS. 3 to 6, mainly focusing on the operation of timer setting through operation panel 20. In the flow chart, "TIMER OPERATION" generally represents that the timer is in the optional timer input mode.

Figure 3:
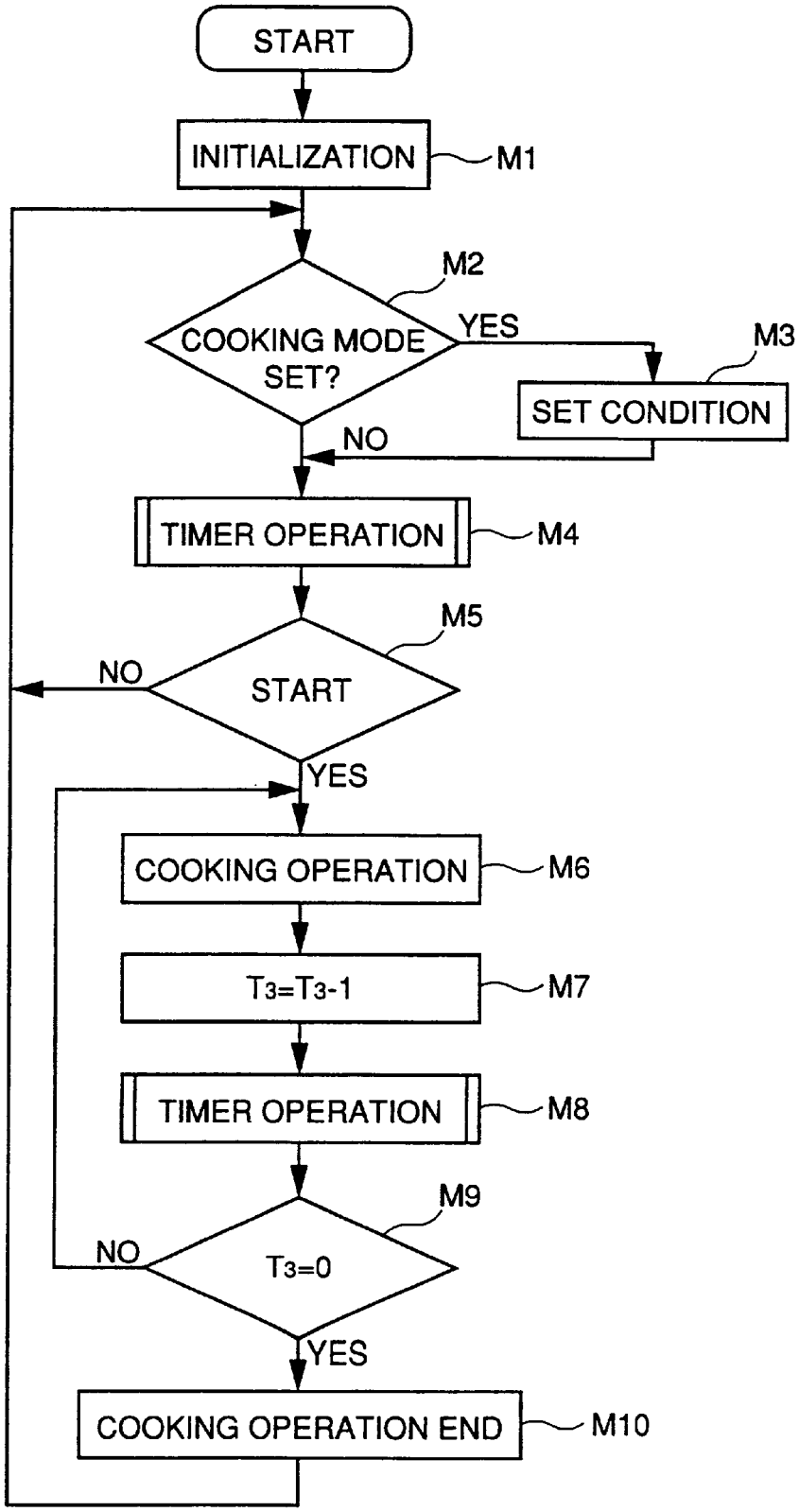
FIG. 3 is a flow chart related to operation of the microwave oven controlled by the control circuit.

Referring to the main routine of FIG. 3, after initialization in step M1, whether a cooking mode is input through menu key 27 or not is determined in step M2. When it is determined that the cooking mode is input, the flow proceeds to step M3 where a cooking time T3 set in advance corresponding to the input cooking mode is set in timer unit 24, and the cooking time T3 is displayed on display portion 25. When it is determined in step M2 that the cooking mode is not input, the flow directly proceeds to step M4.

In step MN14, the subroutine of optional timer input mode, which will be described later, is executed. Thereafter, in step M5, whether start key 26 is turned ON or not is determined. When it is determined that start key 26 is turned ON, magnetron 12 is driven based on the cooking time T3 set in step M3. The subroutine of optional timer input mode is also executed when the optional timer input mode is set within the cooking time T3 (steps M6 to M8). After the lapse of cooking time T3, driving of magnetron 12 is stopped, and the flow returns to step M2 (steps M9, M10).

Figure 4:
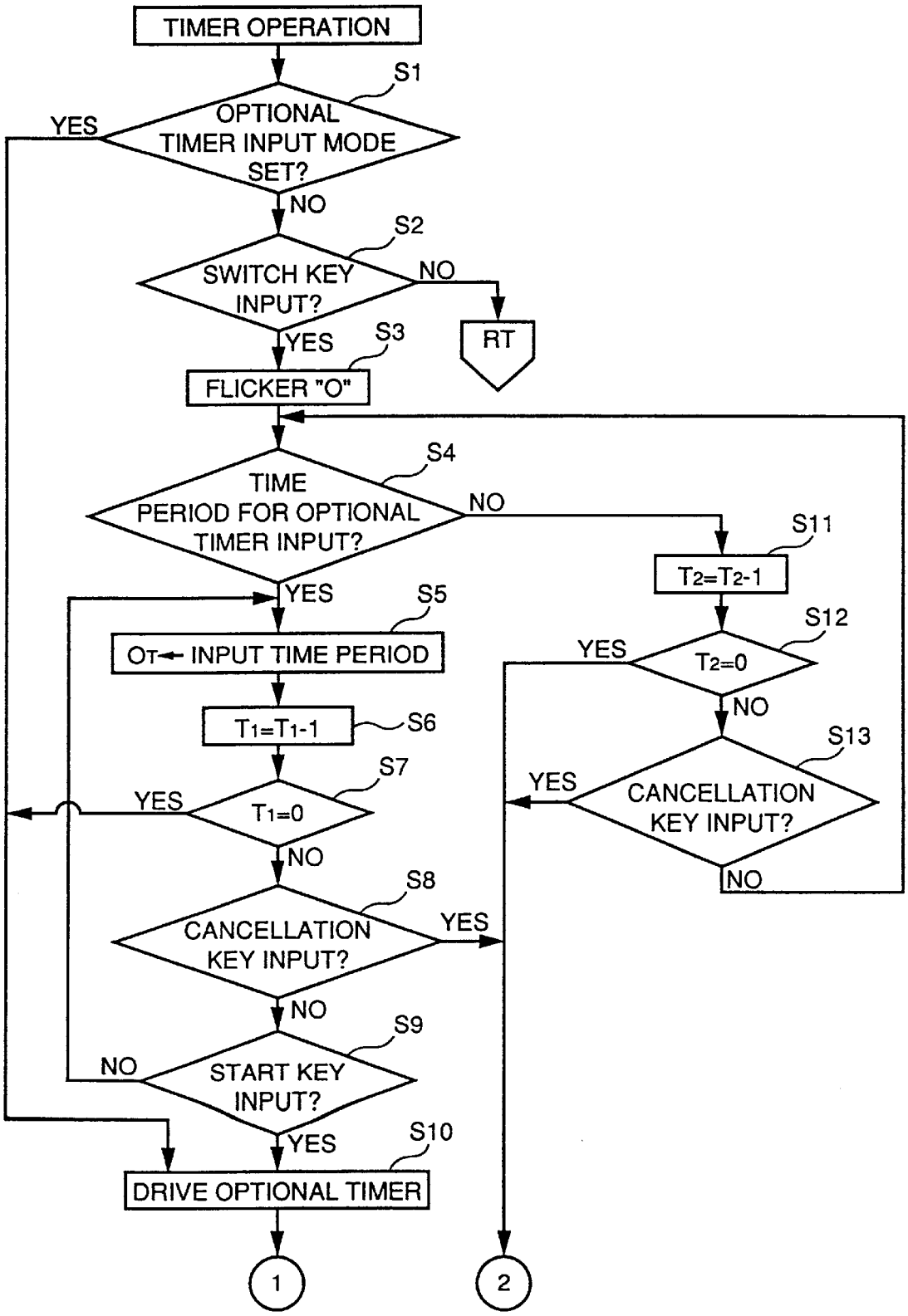
FIGS. 4 to 6 are flow charts showing the subroutine of optional timer input mode of FIG. 1.
Figure 5:
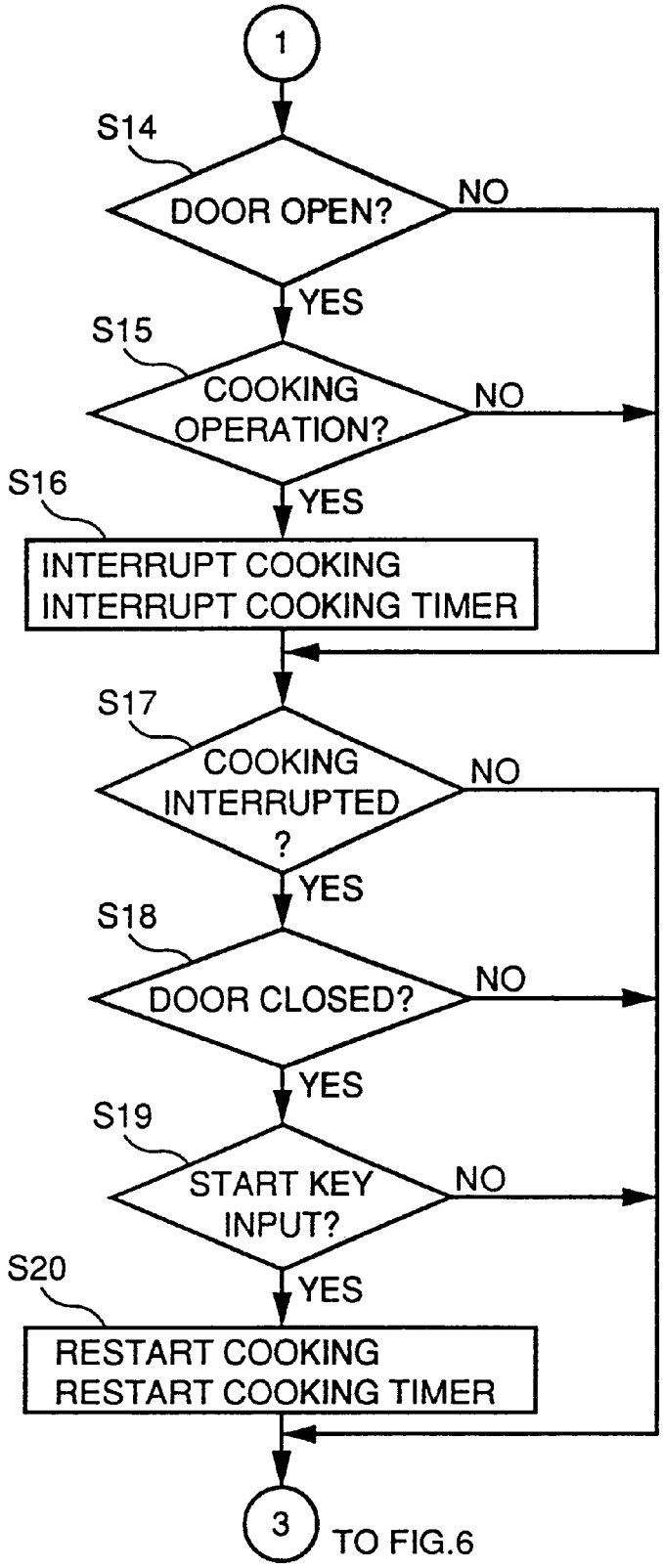
Figure 6:
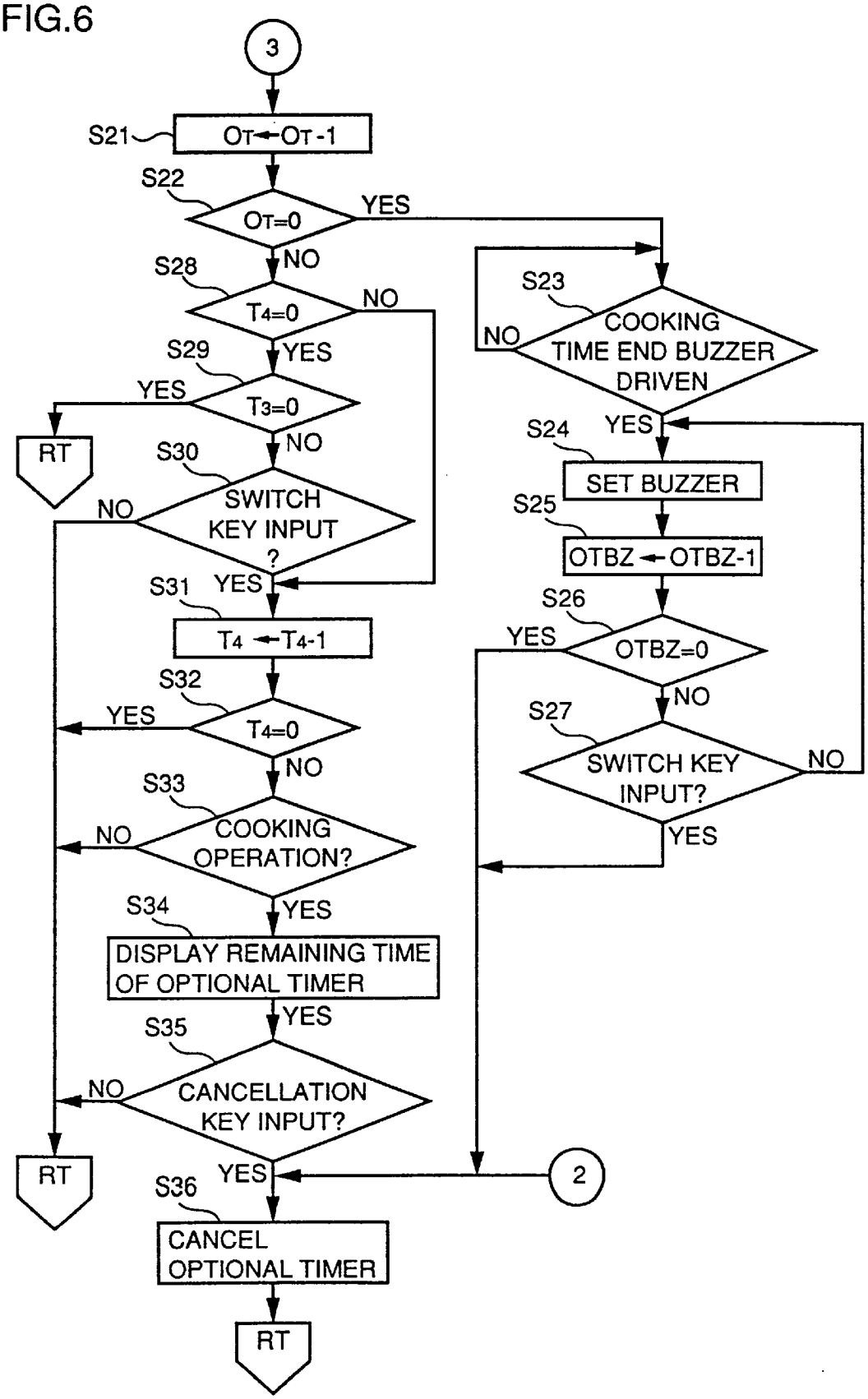

The subroutine of the optional timer input mode mentioned above (steps M4 and M8) will be described with reference to FIGS. 4 to 6.

In the optional timer input mode, in step S1, whether optional timer input mode has already been set or not is determined in step S1. If it is determined that the optional timer input mode is not set, the flow proceeds to step S2 and waits for input through switch key 22. When there is an input through switch key 22, "O" is flickered on display portion 25 in step S3 to indicate that the optional timer input mode is ON.

Thereafter, in step S4, whether the time period for the optional timer is input through ten keys 23 or not is determined. If it is determined that the time period for the optional timer has been input, the flow proceeds to step S5 where the time period OT (arbitrary time period) for the optional timer is set in the timer unit 24.

Thereafter, in step S6, a predetermined time period T1 for automatically starting timer operation, as a first prescribed time period of, for example, 5 seconds is counted by timer unit 24. In step S7, after the lapse of time period T1 for automatically starting timer operation, the flow proceeds to step S10 where timer unit 24 is driven to start counting the arbitrary time period OT for the optional timer (count down). The time count is displayed on display portion 25. Assuming that the time period OT for the optional timer is 2 minutes, the display is "02:00O" (with O flickering), which is displayed for 5 seconds. Thereafter, the display is switched to the initial display or time count of cooking time T3.

Because of such timer automatic starting function, when the mode is switched to the optional timer input mode by switch key 22 and time period is input through ten keys 23, counting of the time period OT for the optional timer is started after a prescribed first time period without waiting for the input through start key 23, and the time count is displayed on display portion 25. Accordingly, even when the user forgets to operate start key 26, counting of the time period OT for the optional timer is automatically started, and the count value is displayed on the display portion 25, and therefore sufficient information to prevent confusion of the set mode by the user can be provided.

In step S7, when there is not any input through cancellation key 28 before the lapse of time period T1 for automatically starting timer operation, input from start key 26 is accepted, timer unit 24 is driven, a buzzer is driven for a prescribed time period and counting of the time period OT for the optional timer starts (steps S8 to S10). At the start of count down, the time count is given on display portion 25 for 5 seconds, and thereafter, time count of cooking time T3, for example, is given.

If it is determined in step S4 that the time period for the optional timer is not input through ten keys 23, the flow proceeds to S11, where a time period T2 for automatically reset the timer as a second prescribed time period of, for example, 10 seconds is counted by timer unit 24. In step S12, when the time period T2 for automatically resetting timer operation is expired, the flow proceeds to step S36 where the optional timer input mode is canceled, and the mode is switched to cooking time input mode. At the same time, flickeiing of "O" on display portion 25 is terminated, and the initial screen or time count of cooking time T3 is displayed.

Because of the function of automatically resetting the optional timer, when the mode is switched to the optional timer input mode by switch key 22 and input through ten keys 23 is absent within the second prescribed time period, the optional timer input mode is canceled without waiting for an input through cancellation key 28 and the mode is switched to the cooking time input mode. Therefore, the standby state waiting for the input with "O" flickering on display portion 25 does not continue long. Accordingly, even when the user forgets to operate cancellation key 28, whether the set input mode is the optional timer input mode or the cooking time input mode can readily be determined by the display on the display portion 25.

In step S12, if there is an input from cancellation key 28 before the lapse of time period T2 for automatically resetting the optional timer, the flow proceeds to step S36 where the optional timer input mode is cancelled, the mode is switched to the cooking time input mode, flickering of "O" on display portion 25 is stopped and initial screen is displayed (step S13).

In step S14, whether the door 13 is open/closed is determined by door sensor 13*a*. If it is determined that the door 13 is open, the flow proceeds to step S15 where driving of magnetron 12 is confirmed. If it is determined that the magnetron 12 is being driven, in step S16, driving of magnetron 12 is stopped and the cooking time input mode is interrupted. In this manner, time count of the cooking time by timer unit 24 in the cooking time input mode is stopped, and time count T3 on display portion 25 is switched to an indication of the stopped time.

At this time, counting of the time period for the optional timer by timer unit 24 in the optional timer input mode continues no matter whether the door 13 is open/closed. When the time count of the time period for the optional timer is given on display portion 25, the display of the time count is continued. In other words, the timer unit 24 can be driven in the optional timer input mode independent from the open/closed state of door 13 and from driving of magnetron 12. Further, it is possible to simultaneously execute the cooking time input mode and the optional timer input mode, by driving timer unit 24.

In step S17, whether the cooking time input mode is set or not is determined. If it is determined that the cooking time input mode is set, the flow proceeds to S18, in which whether door 13 is open/closed is determined based on an output from door sensor 13*a*. If it is determined that the door 13 is closed, the flow proceeds to S19, in which whether there is an input from start key 26 or not is determined. If there is an input, driving of magnetron 12 is re-started, counting of cooking time by timer unit 24 in the cooking time input mode, which has been interrupted, is re-started, and the time is counted down starting from the cooking time at the time of interruption given on display portion 25, in step S20.

In step S21, if there is an input of time period OT in the optional timer input mode, the flow proceeds to step S22. When the time period OT for the optional timer is expired (YES in S22), the flow proceeds to step S23 in which whether time count of the cooking time by timer unit 24 in the cooking time input mode is completed or not, and whether a buzzer notifying the end of cooking is driven (for about 2 seconds) or not are determined. If the answer of the determination is YES, driving of a buzzer notifying the end of timer operation, that is, expiration of time period OT is set (step S24). The timer operation expiration buzzer is given in different sound and different duration so as not to be confused with the buzzer notifying the end of cooking. The time of driving OTBZ of the timer expiration buzzer is set to 7 seconds, for example (step S25).

When the time OTBZ for driving the timer expiration buzzer elapsed in step S26, the flow proceeds to step S36 where the optional timer input mode is canceled, the mode is switched to cooking time input mode, and the display on display portion 25 is returned to the initial display.

When there is not an input from key 22 in step S27 before expiration of time OTBZ for driving the timer expiration buzzer in step S26, the flow returns to S24. If there is an input from key 22, driving of the timer expiration buzzer is stopped, and the flow proceeds to step S36.

When there is a request of displaying time count of the time period OT for the optional timer on display portion 25 before expiration of the period OT for the optional timer in step S22, the time count is displayed on display portion 25. The time period for giving the time count display (recall display time) T4 is 5 seconds, for example (step S28). After the end of recall display time T4, display of time count of OT for the optional timer on display portion 25 is stopped and in step S29, whether cooking time T3 for driving magnetron 12 has passed or not is determined. If the cooking time T3 has not yet been expired and there is an input from switch key 22 in step S29, then the flow proceeds to step S30, and whether there is an input from switch key 22 or not is determined.

When it is determined in step S30 that there is an input from switch key 22, recall display time T4 is set in timer unit 24, the recall display time T4 is counted, whether cooking time T3 for driving magnetron 12 has passed or not is determined, and time count of the time period OT for the optional timer is displayed (steps S31 to S34).

In step S35, if there is an input from cancellation key 28, the flow proceeds to step S36 where the optional timer input mode is canceled, the operation is switched to the cooking time input mode, and the display on display portion 25 is returned to the initial screen.

As described above, as the function of automatically starting timer operation is provided, counting of the time period OT for the optional timer is started without waiting for an input through start key 26, and the time count is displayed on display portion 25. Therefore, even when the user forgets to operate start key 26, counting of the time period OT for the optional timer is started automatically. Accordingly, information related to the optional timer input mode and the cooking time input mode can be displayed selectively on one display portion 25, and relevant information can be provided without causing any confusion by the user.

Further, as the function of automatically resetting timer operation is provided, the optional timer input mode can be canceled, the operation can be switched to the cooking time input mode, and such cancellation and switching can be displayed on display panel 25, without waiting for an input through cancellation key 28. Therefore, the standby state waiting for the input with "O" flickering on display portion 25 does not continue long. Accordingly, even when the user forgets to operate cancellation key 28, it can be readily determined whether the presently set input mode is the optional timer input mode or the cooking time input mode, by the display on display portion 25.

Further, the timer unit 24 can be driven in the optional timer input mode, independent from the state of open/close of the door 13 and from driving of magnetron 12 and therefore both the cooking time input mode and the optional timer input mode can be executed simultaneously.

Figure 7:
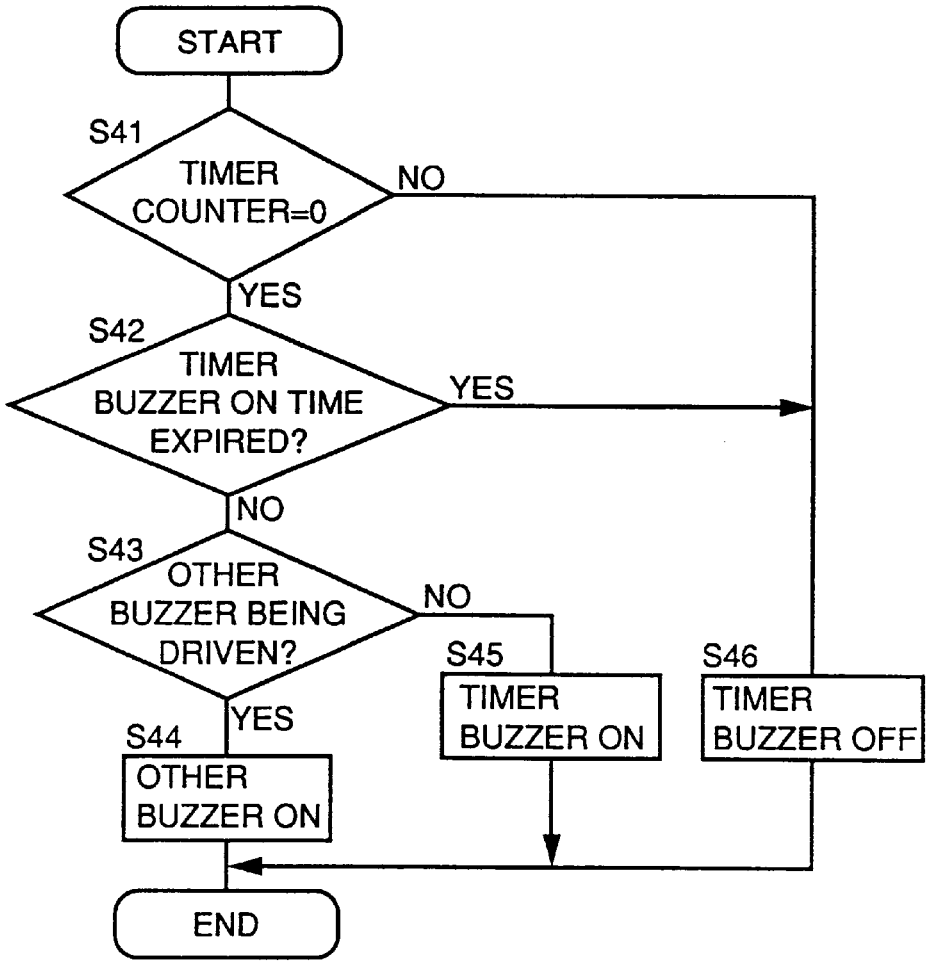
FIG. 7 is a flow chart showing a process when operations of the optional timer and the cooking timer are overlapped.

An operation when time periods of the optional timer and the cooking timer expire simultaneously will be described. FIG. 7 is a flow chart showing the operation in that case. Referring to FIG. 7, value of an optional timer counter indicating elapsed time of the optional timer is confirmed (S41). If the value attains 0 (YES in S41), whether the ON time of the optional timer buzzer has passed or not is determined (S42). If not (NO in S42), whether another buzzer, for example, the buzzer for the cooking timer is ON or not is determined (S43). If the other buzzer is ON (YES in S43), the other buzzer and the buzzer notifying expiration of the optional timer period are both given together (S44).

If the other buzzer is not ON (NO in S43), then the buzzer for the optional timer only is turned ON (S45). If the timer counter for the optional timer is not 0 (NO in S41) or when the ON time for the optional timer has passed (YES in S42), then the buzzer for the optional timer is kept off (S46).

Figure 8:
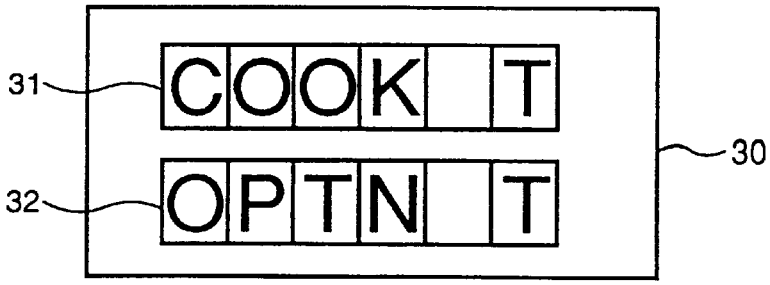
FIG. 8 shows another example of the display portion.

Though the display on the display portion is switched to either the cooking time input mode or the optional timer input mode in the above described embodiment, displays of both modes may be given. FIG. 8 shows an example of such display. Referring to FIG. 8, display portion 30 includes a cooking time display unit 31 and an optional timer display unit 32.

The display unit is not limited to a display portion, and LEDs or other display device may be used.

Though a microwave oven using magnetron has been described as an example of the cooking apparatus, application of the present invention is not limited thereto, and the present invention may be applied to an oven or a toaster using electric heater or the like.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A cooking apparatus for heating and cooking food, comprising:

heating means for heating the food;

mode setting means allowing setting of a first mode for setting time of heating by said heating means, and a second mode setting an arbitrary time period other than the time for heating by said heating means;

time input means for inputting time period in the set mode when said first or said second mode is set by said mode setting means; and means for automatically starting counting of said input time period, after a first predetermined time period from the input by said time input means, when said second mode is set by said mode setting means.

2. The cooking apparatus according to claim 1, wherein setting of said second mode is changed to said first mode when input of time period by said time input means is absent within a second prescribed time period from the setting of said second mode by said mode setting means.

3. The cooking apparatus according to claim 1, further comprising a heating chamber for accommodating the food, a door for putting in/taking out the food to and from the heating chamber, and door open/close detecting means for detecting whether said door is open/closed; wherein said time count is interrupted if said door open/closed detecting means detects said door being open while time count is being done in said first mode, and said time count is continued if said door open/closed detecting means detects said door being open, while time count is being done in said second mode.

4. The cooking apparatus according to claim 1, wherein setting of said second mode by said mode setting means is accepted even when said door open/closed detecting means detects said door being open.

5. The cooking apparatus according to claim 1, further comprising display means for displaying said time count, said display means displaying, when said first and second modes are both set by said mode setting means and counted, a first time count in said first mode and a second time count in said second mode.

6. The cooking apparatus according to claim 5, wherein said display means includes a single time count display unit, said time count display unit selectively displays said first and second time counts in mutually distinguishable manner.

7. The cooking apparatus according to claim 5, further comprising sound output means for giving a sound notifying end of time count at the end of said time counting operation, said sound output means giving different sounds for the end of said first time count and said second time count.

8. A cooking apparatus including a heat chamber having heating means for heating and cooking food, a cooking apparatus body having an inlet to be open/closed provided in front of the heating chamber, and a control circuitry provided in the cooking apparatus body for controlling driving of the heating means, wherein said control circuitry includes mode switching means for switching between a cooking time input mode for setting and inputting time of driving the heating means, and an optional timer input mode for setting and inputting an arbitrary time period for an optional timer, time input means for inputting a time period of set input mode, time counting means for separately counting time periods of respective input modes input by the time input means, displaying means for displaying time period of one of the input modes counted by the time count means in a switched manner based on switching of the mode switching means, and time count starting means for starting counting of the time input by said time input means; wherein after the mode switching means switches to the optional timer input mode and there is an input of time period for the optional timer through the time input means, counting of said time period for the optional timer by said time count means is started after a first predetermined time period, not waiting for an instruction to start time count by said time count starting means.

* * * * *